United States Patent [19]

Naab et al.

[11] Patent Number: 4,889,462

[45] Date of Patent: Dec. 26, 1989

[54] LOADING APPARATUS FOR EMPTYING CONTAINERS INTO A COMMON RECEPTACLE

[75] Inventors: Jakob Naab, Mainz-Laubenheim; Arno Gajewski, Münster-Sarmsheim, both of Fed. Rep. of Germany

[73] Assignee: Zoller-Kipper GmbH, Mainz/Laubenheim, Fed. Rep. of Germany

[21] Appl. No.: 139,416

[22] Filed: Dec. 30, 1987

Related U.S. Application Data

[63] Continuation-in-part of Ser. No. 767,308, Aug. 19, 1985, Pat. No. 4,722,658.

[30] Foreign Application Priority Data

Aug. 21, 1984 [DE] Fed. Rep. of Germany ..... 3430643
Jul. 27, 1985 [DE] Fed. Rep. of Germany ..... 3527022

[51] Int. Cl.[4] ..... B65F 3/04

[52] U.S. Cl. ..... 414/408; 414/420

[58] Field of Search ..... 414/403, 404, 406, 408, 414/409, 425, 548, 552, 567, 572, 573, 589, 590, 555, 419, 420, 421

[56] References Cited

U.S. PATENT DOCUMENTS 3,762,586 10/1973 Updike, Jr. ..... 414/408
3,957,880 4/1976 Hill et al. ..... 901/46 X
4,365,922 12/1982 Borders ..... 414/406
4,479,751 10/1984 Wyman et al. ..... 414/406
4,575,300 6/1984 George ..... 414/406
4,613,271 9/1986 Naab ..... 414/408 X
4,687,405 8/1987 Olney ..... 414/408
4,726,726 2/1988 Dossena et al. ..... 414/404 X

FOREIGN PATENT DOCUMENTS 8303242 9/1983 Australia ..... 414/422
3614328 10/1987 Fed. Rep. of Germany ..... 414/406

*Primary Examiner*—Robert J. Spar
*Assistant Examiner*—Robert S. Katz
*Attorney, Agent, or Firm*—Herbert Dubno

[57] ABSTRACT

A dumping apparatus for rubbish and garbage bins which can either be a single large container or a plurality of small containers can have, at the end of an arm extendable toward the container or containers and liftable to permit the containers to swing over the collecting space in a truck, one or a pair of transport units which are self-adjusting against the container or containers. Preferably two such units are provided on opposite sides of a fulcrum of a transverse beam provided with a rotator element which automatically restores a normal position for lifting and dumping. The beam is locked in this position. The individual transport units can have their gripper and bracing elements connected to a tilting frame by flexible joints which also can be locked.

27 Claims, 10 Drawing Sheets

LOADING APPARATUS FOR EMPTYING CONTAINERS INTO A COMMON RECEPTACLE

CROSS REFERENCE TO RELATED APPLICATION

This application is a continuation-in-part of our copending application Ser. No. 06/767,308 filed Aug. 19, 1985, now U.S. Pat. No. 4,722,658 issued Feb. 25, 1988.

FIELD OF THE INVENTION

Our present invention relates to a loading apparatus for emptying containers or dumping the contents of containers into a common storage or transport receptacle, bin or the like, and, more particularly, to dump or dump-type lift apparatus for loading the contents of garbage containers into the common bin of a garbage truck.

BACKGROUND OF THE INVENTION

A loading or dump-type apparatus for emptying containers into storage receptacles, bins, compartments, and the like generally comprises a dump frame, a pickup attachment and a pickup support attached by at least one mount to the dump frame, at least one guide mechanism and at least one drive mechanism for providing the required dumping and lifting motions of the dump frame to perform the emptying of the containers.

The prior art loading apparatus, particularly dump or dump-type lift apparatus for emptying garbage containers, require comparatively many operating personnel for auxiliary work necessary to get the container to be emptied from its location, to transfer it to the emptying mechanism on the common storage container, and to put back the emptied container again into its original location.

Bringing the storage container with the emptying apparatus to the container to be emptied is often time consuming and in many cases is difficult. These operating methods are profitable only when large and heavy containers are to be emptied, for example, those with 5 $m^3$ capacity and more. Also in such a case the operator of the movable storage receptacle, for example, a garbage or dust bin truck, must, after advancing to the container to be emptied usually leave the cab of the truck, in order to properly apply the pickup support of the emptying mechanism to the container to be emptied.

There are a variety of loading devices known for emptying containers into storage receptacles, for example those in the form of dump or dump-type lift apparatuses. A typical loading apparatus is equipped with a dumping and lifting mechanism, which is brought to and grasps the container to be emptied, raise and dump it until the contents of the container fall into the inside of the common storage receptacle, and then put the emptied container down into its proper place. Also, either rear wall, side wall or top loading is known in the prior art. In each case the known loading apparatus requires auxiliary workers for applying and transferring the container to be emptied to the loading apparatus and for removing the emptied container form the work area. Thus considerable care is required in handling the container to be emptied during its emptying by the loading apparatus.

OBJECTS OF THE INVENTION

It is the principal object of the present invention to improve upon the apparatus described in our copending application Ser. No. 06/767,308, now U.S. Pat. No. 4,722,658.

It is an object of our invention to provide an improved loading apparatus for emptying the contents of containers into a common container, particularly for emptying garbage containers into the storage compartment of a garbage truck.

It is also an object of our invention to provide an improved dump or dump-type lift apparatus for emptying the contents of containers into a common receptacle.

It is another object of our invention to provide an improved loading apparatus for emptying containers into a common storage receptacle which provides a more reliable pickup of the containers than those of the prior art.

It is a further object of our invention to provide an improved loading apparatus for emptying containers into a common storage bin which reliably moves to and picks up the containers to be emptied, and does not require that the container be placed exactly manually on the loading apparatus as do those of the prior art.

It is a further object of our invention to provide an improved loading apparatus for emptying containers into a common storage container, particularly for emptying garbage containers into the storage bin of a garbage truck which has a more automatic, reliable pickup of the containers to be emptied than those of the prior art.

SUMMARY OF THE INVENTION

These objects and others which will become more apparent hereinafter are attained in accordance with our invention in a loading apparatus for emptying containers into a common storage container, particularly for emptying garbage containers into the storage bin of a garbage truck, comprising a dump frame having a dump axis, a pickup attachment and a pickup support for the containers to be emptied attached to at least one mount on the dump frame, at least one guide mechanism and at least one drive mechanism for producing the dumping and lifting motions required of the dump frame in order to empty the containers.

According to our invention the mount of the pickup attachment and the pickup support for the container to be emptied on the dump frame are constructed to allow a limited movability of the mount of the pickup attachment and the pickup support with respect to the dump frame with the dump frame set in a position to receive the container to be emptied.

Also according to our invention alignment mechanisms for proper orientation and alignment of the mount of the pickup attachment and the pickup support for a container being picked-up and raised from its location with respect to the opposing dump frame set in a pickup position are provided.

Further according to our invention a restraining mechanism for fixing the pickup attachment and the pickup support in a standard or normal position on the dump frame is provided, which is constructed and/or controlled to provide a fixed interlocked engagement of the pickup attachment and the pickup support on the one hand and the dump frame on the other hand, in order to achieve a fixed raised position after leaving the pickup position of the dump frame.

Because of the above structural features the pickup attachment and the pickup support on the dump frame can be more or less flexibly fitted to the container to be emptied, when this container is brought together with the pickup attachment and the pickup support from one direction or the other oriented somewhat slantedly or laterally staggered with respect to the pickup attachment and the pickup support. Because of the movability of the pickup attachment and pickup support with respect to the dump frame an appropriate adjustment occurs to provide a reliable engagement of the appropriate parts on the container and in the pickup attachment during pickup. In this way an engagement of the loading apparatus and the container to be emptied is provided, so that the container can be easily raised form its location, and by proper alignment of the pickup attachment and the pickup support opposing the dump frame, it is possible directly to bring the container to be emptied into the standard position for respect to the dump frame desired and required for emptying. In this normal or standard position according to our invention then the pickup attachment and the pickup support are restrained or fixed on the dump frame. Thus the same conditions for the loading or emptying process are provided, as in the exact mounting and transfer of a container to a loading apparatus performed with the highest precision.

According to the special requirements and the relationships particularly defined by the container to be emptied and the emptying or dumping mechanism, the number and the type of the degrees of freedom provided for the relative motion of the pickup attachment and the pickup support with respect to the dump frame are chosen.

For example, the mount for the pickup attachment and for the pickup support is constructed to permit a limited movability of the pickup attachment and the pickup support laterally parallel to the dump axis of the dump frame with respect to the dump frame set in position to pick up the container to be emptied. This degree of freedom has a particular significance, because lateral displacement in application of the loading apparatus to a container to be emptied standing in a particular location might be normally difficult or at least required employment of additional information gathering steps, in order to reliably place the loading apparatus in engagement with the appropriate parts of the container for an exact fit required for an exact reliable pickup. By the limited lateral adjustability of the pickup apparatus and the pickup support of the loading apparatus the bringing together of the loading apparatus with the container to be emptied can be performed with greater precision. Moreover the pickup apparatus and the pickup support by an easy lateral shift with respect to the dump frame can be precisely placed against the corresponding parts of the container to be grasped and then, when the container is easily raised from its location, the precise lateral alignment with respect to the dump frame for the emptying process can be made.

Another degree of freedom for motion of the pickup attachment and the pickup support is provided by our invention by construction of the mount for the pickup attachment and the pickup support to allow a limited swinging of the pickup attachment and the pickup support about a substantially central vertical axis of the dump frame in the pickup position. This degree of freedom of motion has particular significance with bar-shaped pickup attachments and pickup supports which are provided for the pickup of relatively wide containers.

By the limited rotatability of the pickup attachment and the pickup support about the substantially vertical central axis of the dump frame, the pickup attachment and pickup support in a slanting contact with the container to be emptied can pivot until the pickup attachment reaches a suitable parallel position for engaging the parts of the container to be grasped, in order to guarantee a satisfactory reliable engagement and to raise the container to be emptied from its location by raising the dump frame. When this occurs, the container to be emptied can be oriented and aligned in the correct normal position for the emptying process with respect to the dump frame.

A further degree of freedom of motion according to our invention of the mount of the pickup attachment and the pickup support with respect to the dump frame is provided by construction of the pickup attachment and pickup support to allow a limited swinging motion of the pickup attachment and also the pickup support in a substantially vertical plane parallel to the dump axis of the dump frame with the dump frame set in a pickup position. This limited movability of the pickup attachment and also the pickup support with respect to the dump frame allows the pickup attachment, particularly bar-shaped pickup attachments for wider containers, at the start of the lifting of the dump frame to be aligned over its entire length or over the entire width of the container to be emptied in the raised position against the elements of the container to be grasped and to make a reliable engagement over the entire container width. That safe engagement being made, then for further lifting and dumping the container to be emptied is raised from its location. The standard correct position of the pickup attachment and the pickup support for emptying with respect to the dump frame, and thus emptying of the container, can therefore be reached.

Finally also according to our invention another degree of freedom of motion of the pickup attachment and the pickup support with respect to the dump frame is provided by constructing the pickup attachment and also the pickup support to allow a limited slanting motion of the pickup attachment and also the pickup support in a plane normal to the dump axis of the dump frame. Hereby the possibility of maintaining more easily the pickup attachment and the pickup support in a reliable, opposing engagement with the container to be emptied is provided.

In a preferred embodiment of our invention the pickup attachment and pickup support for the container to be emptied are mounted on a pickup frame member extending substantially vertically with the dump frame set in position to pickup the container to be emptied, where this pickup frame member by means of the mount allowing a limited movability of the pickup attachment and the pickup support is attached to the dump frame. By the pickup frame member an adjustable unity to the apparatus is provided in the sense of the limited movability provided by the chosen degrees of freedom with respect to the dump frame and therefore with respect to the container to be emptied. The pickup frame member can be mounted at its upper end region by means of a swivel joint on the dump frame and contained in this swivel joint a motion-limiting device effective between the dump frame and the pickup frame member is provided. According to the type and number of the desired degrees of freedom of motion, this swivel joint can be constructed as a universal joint having a motion-limiting mechanism in the form of a bushing device or of a ball-and-socket joint. This motion-limiting mechanism may take the form of a rubber-metal composite element.

Specifically, therefore, the container-dumping apparatus for the emptying of a container into a collecting receptacle, according to the invention, especially for the dumping of refuse bins into a refuse-collecting truck comprises the container-tilting frame previously mentioned which is adapted to be approached to the container to be dumped. Gripper means is provided on the frame for engagement with the container for enabling entrainment of the container with the frame while bracing means is likewise provided on the frame and is adapted to bear against the container when the container is engaged by the gripper means to take up at least part of the weight of the container.

According to this invention, connecting means on the frame join the gripper means and the bracing means into a transport unit adapted to retain and support the container.

An entraining device is provided for coupling the transport unit with the tilting frame while permitting limited mobility of the transport unit relative to the tilting frame.

Position-restoring and alignment means between the transport unit and the tilting frame is effective upon lifting of the tilting frame, the unit and the container carried thereby for shifting the unit into a predetermined normal starting position relative to the frame for dumping of the container and upon a displacement of this unit from its predetermined normal position into an off-normal position as permitted by the entraining device upon engagement of the gripper means with the container.

Arresting means on the frame is actuatable for locking the transport unit in its normal position upon displacement of the unit into this normal position by the position-restoring and alignment means as the tilting frame is lifted for dumping of the container and for releasing the unit upon lowering of the tilting frame to allow again the limited mobility of this unit relative to the tilting frame as permitted by the entraining device.

A preferred possibility for providing a limited movability of the pickup frame member with respect to the dump frame comprises mounting the pickup frame member or transport unit at its upper-end region by means of a swivel joint to the dump frame, the swivel joint being constructed for alignment of the pickup attachment and the pickup support and the developing an automatic restoring force due to displacement from its rest position.

A particularly simple form for this swivel joint comprises a rubber-metal-composite element, for example a universal joint such as a ball-and-socket joint or a bushing device. Such a joint has the advantage that the alignment and orientation of the pickup container with respect to the dump frame is conducted automatically and immediately, as soon as the container is raised from its location by adjustment of the swivel joint developing suitable restoring forces due to displacement form its rest position.

A mechanism of this kind needs only a restraining device for holding the pickup frame member fixed in its normal position on the dump frame. One such restraining device can be mounted, for example pivotally on the dump frame and in its closed configuration surrounds the pickup frame member like a clamp and has controllable restraining jaws.

For laterally limiting the motion of the pickup frame member the swivel joint between the pickup frame member and the dump frame is mounted inside of a laterally shiftable spring-loaded centering mechanism attached to the dump frame.

Since the loading apparatus of our invention provides for a twin alignment process of the container to be emptied with respect to the dump frame for conducting a particular emptying process, namely:

(a) alignment of the pickup attachment and the pickup support with respect to the container to be emptied, and (b) alignment of the pickup attachment and the pickup support together with the container to be picked-up with respect to the dump frame.

It is appropriate to provide protection so that these alignment processes are run correctly before further steps in the emptying process. To this end the pickup attachment has a container-gripping member with its long axis extending substantially parallel to the dump axis of the dump frame and the pickup, this container-gripping member preferably being shaped like a bar, and the pickup support has a corresponding bottom support, also preferably bar-like, extending parallel to the container-gripping member of the pickup attachment. The container-gripping member and the bottom support on their lateral surface or sides turned toward the container to be picked up are provided with at least one electrical container contact for signal transmission or for automatic activation of the lifting motion of the dump frame, by which a switching process only jointly activated. Preferably on the container-gripping member at least two contacts can be positioned in a line parallel to the long axis of the container-gripping member with clearance from each other, by which the switching process is activated only by joint contact.

According to our invention, a dump or dump-type lift apparatus is particularly characterized by a dump frame supporting a mount for the pickup attachment and also for the pickup support constructed to allow limited movability, which is mounted at the free end of an extendable member of a lifting means provided on a common storage container, and supports an alignment mechanism for alignment of the pickup attachment and the pickup support as well as the restraining mechanism for holding fixed the pickup attachment and also the pickup support.

In another embodiment of the invention, two such retaining and transport units are provided. These retaining and transport units are provided next to one another in laterally-spaced relationship so that the apparatus, using both of these units, can engage a large container or two side-by-side smaller containers simultaneously each with one of the units of the pair.

Preferably, the two retaining and transport units of the pair are mounted on a common transverse beam which, like a double-arm lever, is pivotable on a rotation-permitting bracket in the normal starting position for the emptying process. In this case, on each of the two arms of the transverse beam, a respective retaining and transport unit can be mounted.

The bracket is also provided, according to the invention, with resetting and motion-limiting or blocking devices which position the beam in its normal orientation about its pivot and block it in this position during lifting of the frame. The normal position of the beam, of course, is its intermediate position between rotation of the beam in one or the opposite sense. When the beam is blocked against rotation, normal emptying can proceed.

The gripper means provided on the or each retaining or transport unit can be either comb-like or claw (jaw) like grippers and the bracing can be provided either with simple abutment surfaces, or with means which can also engage or grip the container.

In addition to simple retaining and transport units or pairs of such units as described, we can use gripper and transport plates, e.g. of triangular form, which can engage in pockets formed on the exteriors of the containers to be emptied.

Large containers can have two such pockets spaced apart along a common side thereof, while small containers need only be provided with one pocket each.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
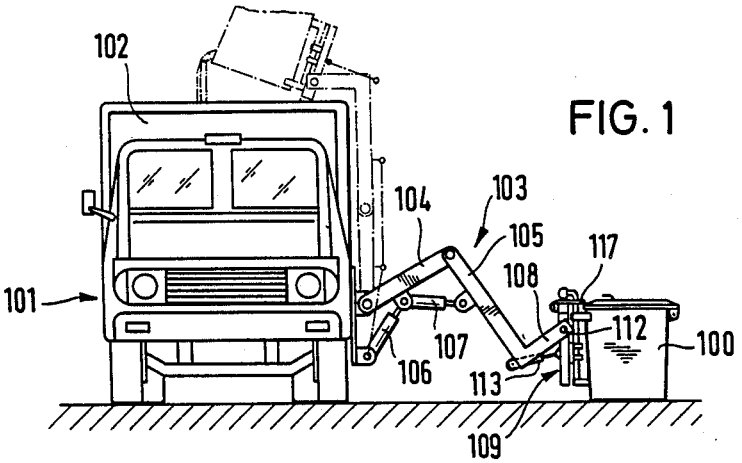
FIG. 1 is a side view of a preferred embodiment of a loading apparatus for emptying garbage from garbage containers according to our invention into a storage chamber of a garbage truck.
Figure 2:
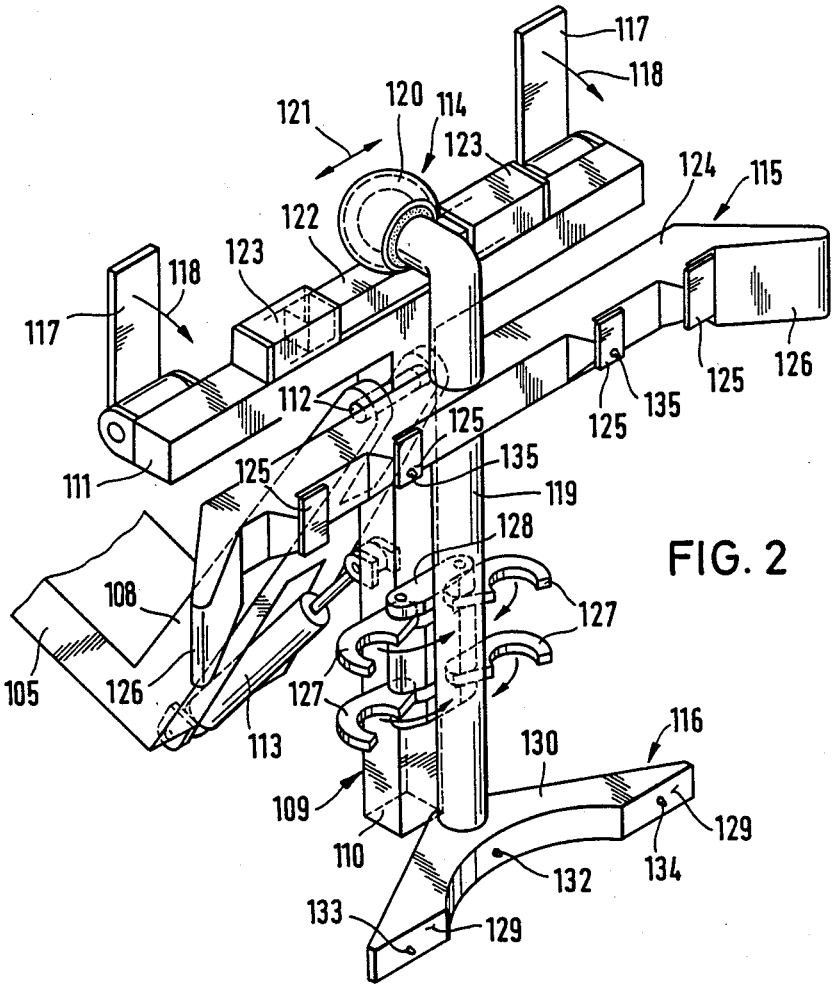
FIG. 2 is a perspective view of a part of the dump mechanism at the free end of an extendable member of the apparatus of FIG. 1.
Figure 3:
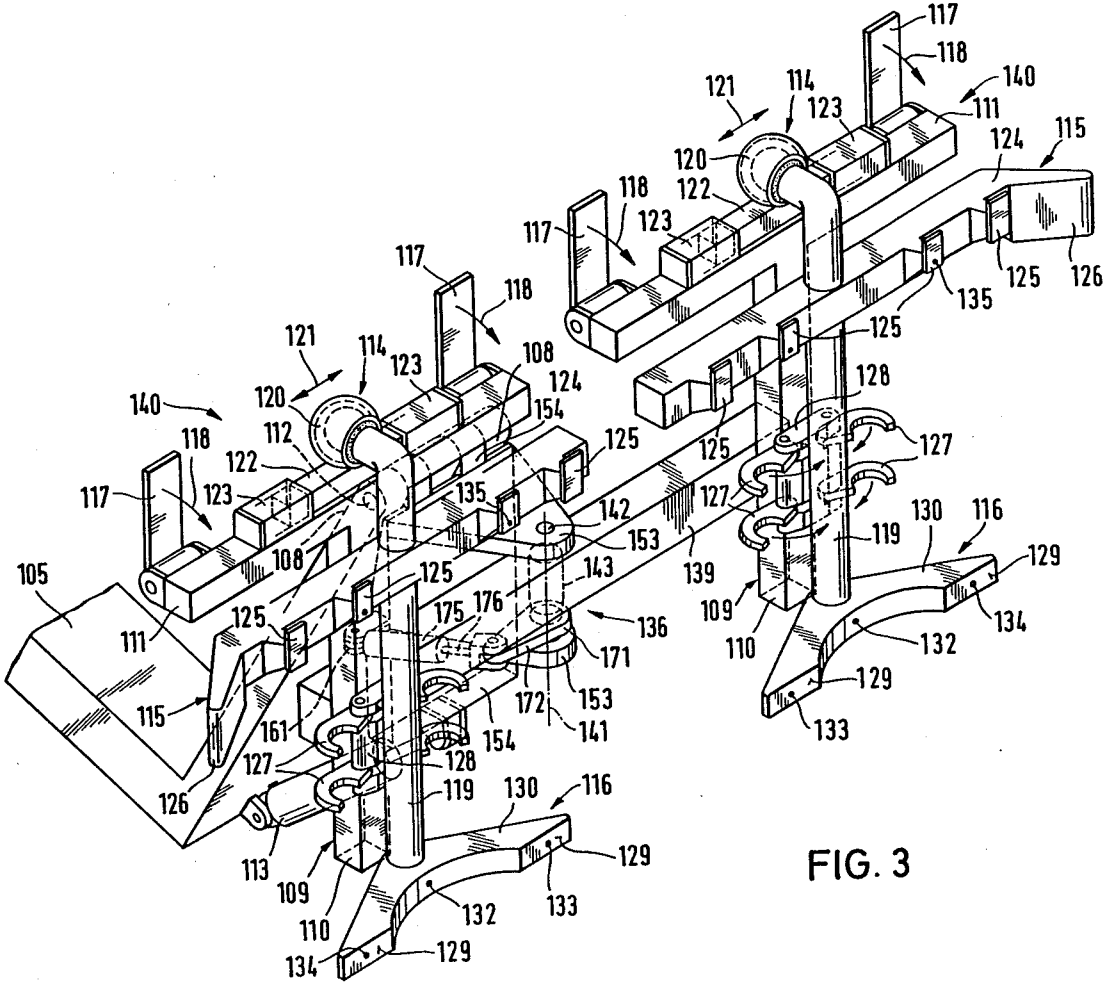
FIG. 3 is a perspective view of another embodiment of the dumping apparatus of the invention which can be used to lift and dump a single large container or, if desired, two smaller containers in side-by-side relationship.
Figure 4:
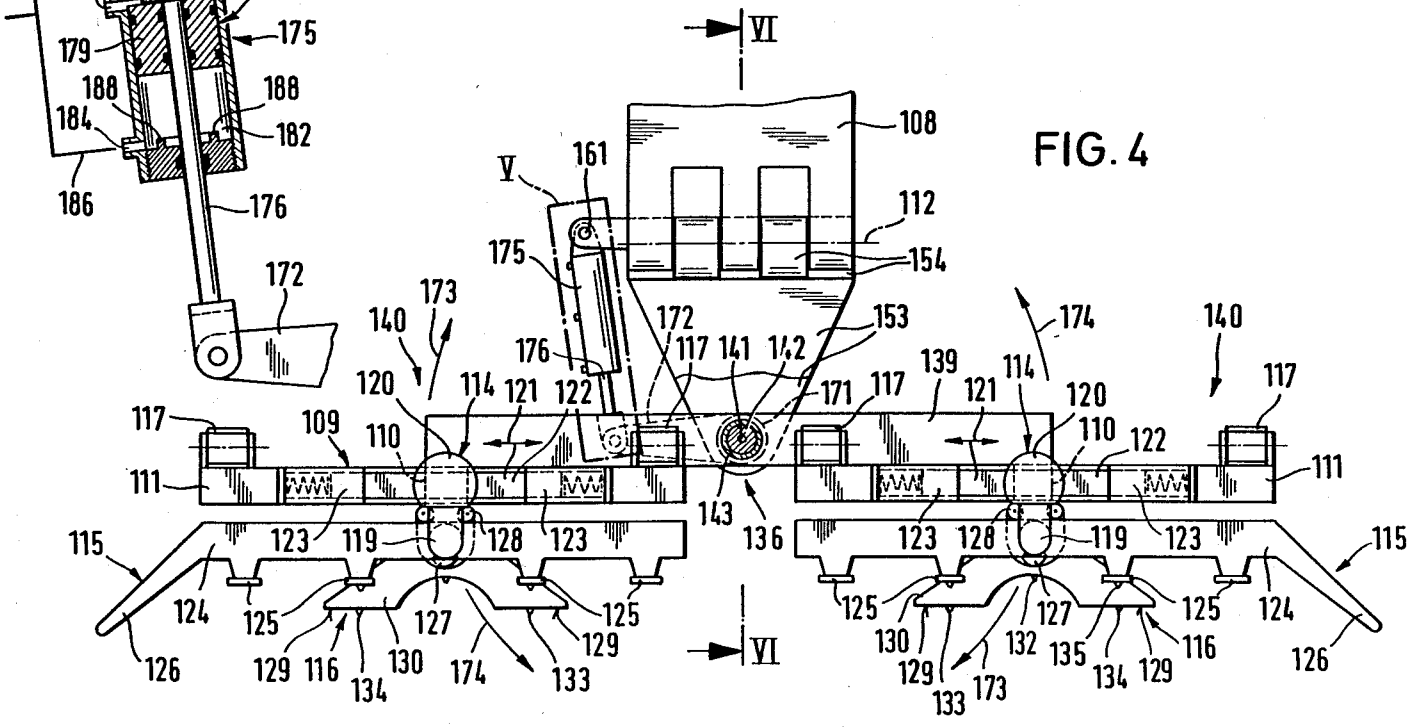
FIG. 4 is a plan view of the apparatus of FIG. 3, partly broken away.

In the embodiment shown in FIGS. 1 and 2 the common storage container or bin 102 carried by a garbage truck 101 is provided on its side with an extendable member 103, which has two arms pivotally connected to each other, namely a lower arm 104 and an upper arm 105. The lower arm 104 is attached to the garbage truck frame so as to be pivotable around an axis parallel to the travel direction of the garbage truck 101 and is also connected to that frame with a first piston-cylinder arm drive 106, by means of which the arm 104 is pivotable upwards and downwards.

The upper arm 105 is attached pivotally at the free end of the lower arm 104 so as to be swingable about an axis parallel to the travel direction of the garbage truck 101. Between the lower arm 104 and the upper arm 105 a second piston-cylinder arm drive 107 is installed, with which both arms 104 and 105 can be spread from or folded toward each other. The upper arm 105 carries at its free end an end segment 108 bent approximately at right angles to upper arm 105.

At the free branched end of this end segment 108 in this first embodiment a T-shaped dump frame 109 (also referred to herein as the container tilting frame), with its vertical T-leg 110 half the thickness of the horizontal T-arm 111, is pivotable around a tilting axis 112 of the frame approximately parallel to the travel direction of the garbage truck 101.

Between the end segment 108 and the vertical T-leg 110 of the dump frame 109 a piston-cylinder dump frame drive 113 is installed.

The dump frame 109 carries on the upper side of its horizontal T-arm 111 a mount 114, for a pickup attachment or gripping means 115 and a pickup support or bracing means 116. Moreover the dump frame 109 has foldable, flap-shaped clamps 117 on its horizontal T-arm 111, which normally are swung back into the rear position shown in FIG. 2 and are swingable in the direction shown by the arrow 118 over the open edge of a garbage container 100 gripped by the pickup attachment 115 for emptying.

The pickup attachment 115 and the pickup support 116 in this embodiment are rigidly attached to each other by a pickup frame member 119, forming connecting means interconnecting the bracing means 116 and the gripper means 115 into a transport unit adapted to retain and support the container. The member 119 extends essentially vertically in engagement with the dump frame 109. The pickup frame member 119 is connected by means of mount 114 with the horizontal T-arm 111 of the dump frame 109.

In the embodiment of FIGS. 1 and 2 this mount 114 comprises a rubber-metal-composite element 120 formed as a ball-and-socket joint, in which the inner surface of the ball socket and the outer surface of the pivot ball attached to the pickup frame member 119 are connected by a rubber filler, wherein this rubber filler is prevulcanized on the inner surface of the ball socket and the outer surface of the pivot ball. The rubber-metal-composite element 120 thus constitutes an entraining device for coupling the transport unit 115, 116, 119 with the frame 109 while permitting limited relative mobility therebetween.

The rubber-metal-composite element 120 has in this manner a rest or equilibrium position and is attached from the front (i.e., the front as viewed facing the side of the garbage truck 101 or the lower arm 104).

It may be swung from this rest position by exterior bending forces in any direction, however it continually tries to return to its rest position, i.e.. the rubber of this joint 120 constitutes a position-restoring and alignment means. Naturally, the movability or bendability of the rubber-metal composite element 120 is limited.

Additionally, besides the limited pivotability of the rubber-metal-composite element 120, this mount 114 offers the possibility of a lateral shift in position according to the double arrows 121 seen in FIG. 2. This lateral shift is allowed because the rubber-metal-composite element 120 is fitted to a rectangular cross-sectioned bar 122, which is axially slidable in rectangular guide sleeve 123. The entraining device also includes the axially slidable bar 122 in the guide sleeve 123.

In this guide sleeve 123, which also forms part of the position-restoring and alignment means, restoring springs are installed, which hold the rectangular cross-sectioned bar 122 with the rubber-metal-composite element 120 under the force of the compressed restoring springs in the middle position shown in FIG. 2.

The pickup attachment 115 has a container-gripping member 124 extending with long axis transverse to and mounted rigidly to the pickup frame member 119, to which gripping plates 125, which grip under the edge of the garbage container 100, are attached. At its outer ends the bow-shaped container-gripping member 124 is provided with slanted, tapered container guides 126.

These container guides 126 are therefore formed to grip and engage the sidewalls on the garbage container 100 as the container-gripping member 124 with its container guides 126 is brought forward to it, and thereby under the spring-like response of the rectangular cross-sectioned bar 122, the container-gripping member 124 with its gripping plates 125 is put in position laterally in engagement with the container 100.

On the vertical T-leg 110 of the dump frame 109 two pairs of clamp-type restraining members 127 of an arresting means are mounted. The members are normally in the open position shown in FIG. 2 and by means of a closing device 128 operated with electrical, pneumatic, hydraulic or mechanical means are adjustable and controllable in a restraining position, in which they surround the pickup frame member 119 in clamp-like fashion and restrain the vertical T-leg 110 of the clamp frame 109.

In operation the loading apparatus described above by suitable operation and control of the extendable member 103 is applied to a garbage container 100. Thereby the container-gripping member 124 with its container guides 126 engages the side walls of the garbage container 100, so that the container-gripping member 124 is laterally positionable against the garbage container 100.

When the gripping plates 125 of the pickup attachment 115 and the bottom support lateral surface 129 of the pickup support 116, comprising the bottom support 130 extending transverse to the pickup frame member 119, come into contact with the side wall of the garbage container 100, the bottom support lateral surface 129 and the surfaces of the gripping plates 125 by flexible adjustment of the rubber-metal-composite element 120 adjust themselves to the sidewall surfaces of the garbage container 100.

The container 100 is then raised by operation of the extendable member 103. Because of that the gripping plates 125 engage in corresponding catch pieces, for example a catch lip of the garbage container 100. Thereby the container-gripping member 124 adjusts itself into position by flexible adjustment of the rubber-metal-composite element 120 against the catch lip or catch pieces of the garbage container 100. Further in the course of the raising of the dump mechanism with the extendable member 103, the garbage container 100 is raised from the ground so that the compressible spring operating on the rectangular shaped bar 122 and the rubber-metal-composite element 120 adjust the pickup frame member 119 into its normal position against the dump frame 109. By operation of the closing device 128, the clamp-like restraining member 127 closes around the pickup frame member 119. A possible still further adjustment of the pickup frame member 119 against the dump frame 109 for emptying of the containers 100 is thereby necessarily eliminated.

As soon as the pickup frame member 119 together with the pickup attachment 115 and the pickup support 116 as well as the container 100 are locked into their standard position, by suitable control of its operating mechanism the flap-shaped clamping device 117 is swung over the open edge of the container 100. By further operation of the extendable member 103, the container 100 is brought into the emptying position shown by dotted lines in FIG. 1. After the emptying occurs, the above-described operation steps are run in reverse and in reverse sequence until the container 100 is again put in its place.

In FIGS. 3–8, we have shown on the second embodiment of the dumping apparatus according to the invention which comprises a pair of container pickup units 140.

Each of these units 140 is constructed identically to the pickup unit of FIG. 2. Consequently, for each of these units we have employed the same reference numerals as are used in FIG. 2 to identify identical parts.

One difference between the embodiment of FIG. 2 and that of FIG. 3–8, is that each of the gripper bars 124 has only one receiving or guide portion 126 and the guide lines 126 are provided at opposite ends of the two bars 124 from one another.

The two pickup units 140 are fastened with the vertical T-shank 110 of the respecting tilting frame to a transverse beam 139, for example, by welding. The transverse beam 139 is formed as a double-arm lever and is rigidly connected at its center with a rotator element 136. The pivot axis 141 of this rotator element extends substantially vertically when the pickup units 140 are in their position in which one or more containers to be emptied are to be picked up.

The two pickup units 140 lie generally flush with one another at their gripper devices 115 and bracing devices 116.

Since the gripper bars 115 are free from the guide members 126 at their ends turned toward one another, a pair of pickup units 140 can together engage a large container which is wider than the gripper means 115 of a single pickup unit but, of course, is not wider than the overall length between the guides 126.

With the individual pickup units 140, moreover, it is possible to pick up two small containers to be emptied.

Both with the pickup of a single large container or in the pickup of two small containers, the transverse beam 139 and its rotator element 136 has the advantage that the beam 139 can swing either in the clockwise sense (arrow 174) or in the counterclockwise sense (arrow 173), backwards or forward to orient the grippers 115 to the large container or two small containers even through the arm 105 may not be precisely perpendicular to the container. The grippers 115 can then be securely engaged with the large container or with the respective smaller containers.

In addition, as had been described in connection with FIG. 2, each of the units 140 has its transport unit consisting of its gripper 115, its bracing member 116 and its connecting post 119 capable of moving relative to its frame to thereby allow individual adjustability of the grippers especially in the case when the grippers 115 engage individual smaller containers.

The rotator element 136 is fastened by means of two supporting lugs 153 on a support plate 154. The support plate 154 is swingable at its upper part about a horizontal axis on an angled end piece 108 of an outrigger arm 103 as has been shown in FIG. 1.

Between the angled end piece 108 and the support plate 154, a piston-and-cylinder unit 113 is connected by means of which the support plate 154 can be tilted about the horizontal axis relative to the end piece 108 for example, to effect the final tilting movement which dumps the container or containers to be emptied into the truck. As is especially apparent from FIG. 6, the rotator element 136 is formed by a journal pin 142 fixed between the two supporting lugs 153, and a support bushing 143 rotatable on these pins. The transverse beam 139 is welded onto this bushing 143 and is swingable with this bushing around the substantially vertical axis defined by the bushing 142 in the senses indicated by the arrows 173 or 174 in FIG. 4.

In its normal intermediate position which is also the normal position or starting position for emptying containers, the transverse beam 139 is at a right angle to the outrigger 103 or at least its upper arm 104 and the angled end piece 108.

To limit the swingability or the angle to which the beam can be deflected about the vertical axis 141 from its intermediate position in the sense of the arrow 173 or 174, the transverse beam is provided in the embodiment of FIGS. 3–8 with restoring and blocking devices.

Figure 5:
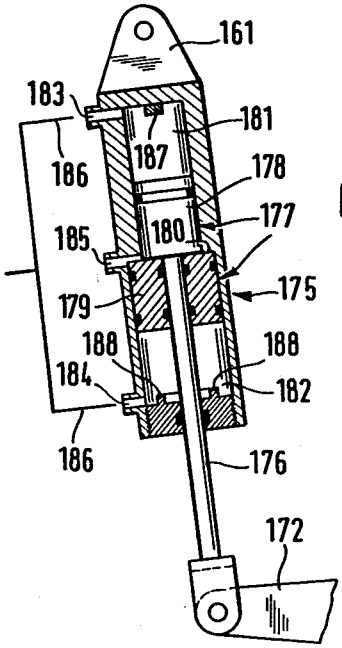
FIG. 5 is a cross sectional view taken along line V—V of FIG. 4.

The support bushing 143 of the rotator element 136 can be rigid with a support plate 171 which is rotatable about the axis 141 on bearing pin 142 and has the pivot lever 172 as a projection therefrom. The piston rod 176 of a hydraulic setting and blocking cylinder 173 pivotally engages this lever (FIG. 5). The other end of the hydraulic setting and blocking cylinder 175 is pivotally connected by an eye 161 to swing about a vertical axis on the support plate 154.

The setting and blocking cylinder 175 contains a differential double-acting piston 177 which comprises a front piston part shaped like a plunger and fixed to the piston rod 176 and an annular axially shiftable annular piston 179 located behind the piston part 178.

Correspondingly, the interior of the positioning and blocking cylinder 175 is formed with two internal compartments which are separated from one another by a shoulder 180. These compartments include a relatively narrow compartment 181 in which the plunger-like forward piston part 178 is slidable and large diameter compartment 182 accommodates the ring-shaped piston part 179. The portion of the chamber 181 which lies ahead of the piston part 178 is provided with a fitting 183 for connection to the hydraulic medium lines while the fitting 184 communicates with the compartment 182 behind the annular piston part 179.

In the region of the shoulder 180, a further fluid connection 185 is provided.

The fittings 183 and 184 are connected by a common fluid line 186 which, in this parallel connection is also tied to the hydraulic control and operating system of the apparatus, namely the hydraulic control and operating system for the hydraulic motors 106, 107, 113 which lift and tilt the apparatus to dump the container or containers.

The fitting 185 opening at the shoulder 180 is connected to the lower pressure or return side of the hydraulic control and operating system, e.g. its reservoir, or can be simply open to the ambient atmosphere.

Figure 7:
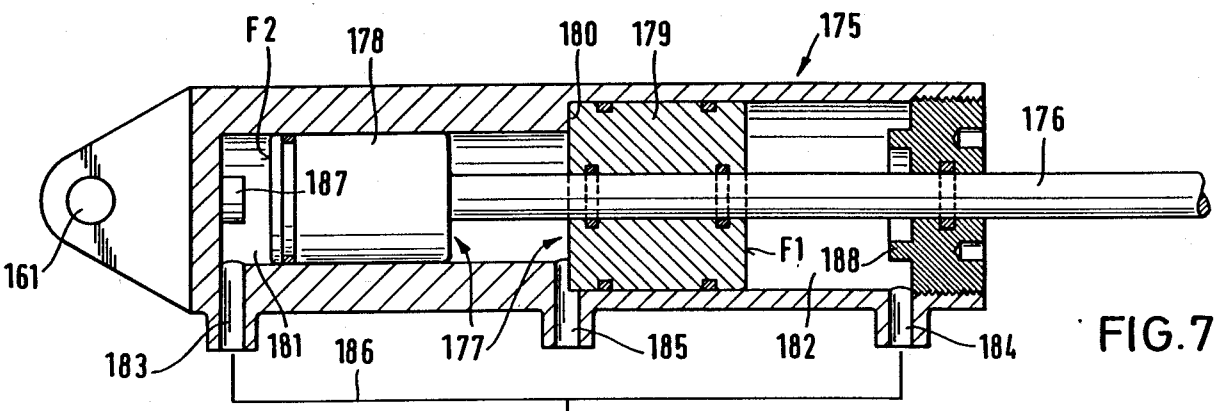
FIG. 7 is a sectional view of the positioning and blocking cylinder of FIG. 5 upon the displacement of the beam thereof in the direction of arrow 173 in FIG. 4.
Figure 8:
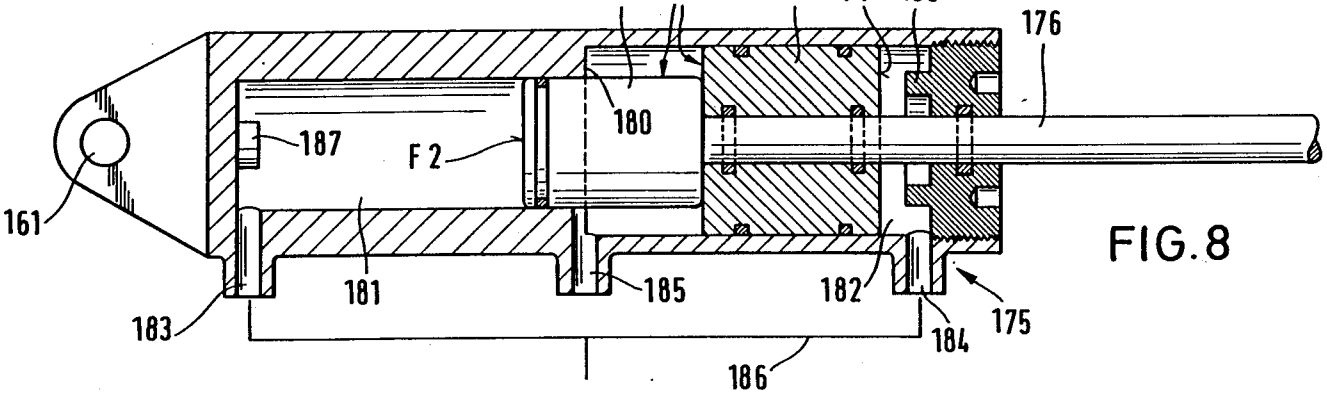
FIG. 8 is a view corresponding to FIG. 7 showing the displacement in the direction of arrow 174 in FIG. 4.

As can be seen from FIGS. 7 and 8, the annular piston part 179 has an effective surface F1 which end at the pressure of chamber 182 and acts counter to the pressure in chamber 181 applied to the oppositely effective surface F2 of the piston part 178. The area F1 is greater than the area of the surface F2, for example, twice as great.

The operation of the dumping apparatus is illustrated in FIGS. 3–8 as is the restoring of the parts into position as the containers are lowered.

In a lowered position of the pickup unit 140, the hydraulic motors 106, 107 and 113 (hydraulic piston and cylinder arrangements) for lifting and tilting the container or containers to be emptied, are substantially relieved of pressure by the hydraulic control and operating system.

The piston parts 178 and 179 ar shifted to the left (FIGS. 7 and 8) and the hydraulic flow between the compartments 181 and 182 serves here simply to damp the displacement to the left which is mechanically induced by a force applied to the piston rod 176.

When the pickup unit 140 is pressed against the large container or two side-by-side smaller containers 100, for self orientation, the transverse support 139 can be swung either in the clockwise sense of arrow 174 or the counterclockwise sense of arrow 173 to allow the self-adjustment and accommodation of the gripper means 115 to the wall of the container to be emptied.

In the case of a swing in the direction of arrow 173, the piston rod 176 is shifted further into the cylinder 175 so that the piston 178 is displaced to the left. This displacement is limited by an abutment 187 in the compartment 181. The annular piston 179 remains during this movement against the shoulder 180.

When the device is then hydraulically actuated for a lifting and dumping operation, hydraulic motors 106, 107, 113 are pressurized and at the same time a hydraulic pressure is generated at the same level in compartments 181 and 182.

The piston 179 is held against the shoulder 180 while piston 178 is shifted from its position shown in FIG. 7 until it abuts the piston 179, thereby swinging the beam 139 into normal starting position for the emptying process.

Since the area of the surface Fl of the annular piston 179 is substantially greater than the area F2 of the piston 178, the annular piston 179 remains held against the shoulder 180 and the restoring means formed by the piston 178 is blocked in the starting position for the emptying process.

However, should the beam 139 be compelled to swing in the opposite sense of arrow 174 when the pickup device 140 is brought against the side of the single large container or the two smaller containers, the piston 178 is drawn to the right by the rod 176 from the normal position and entrains the piston 179 in this direction (see FIG. 8) until the piston 179 engages the abutment 188. The flow of hydraulic fluid from chamber 182 to chamber 181 serves to damp the swing of the beam 139 and the abutment 188 limits that swing.

During the lifting operation, therefore, when the line 186 is pressurized by the hydraulic pressurization of the motors 106, 107, 113, equal pressures are again developed in the compartment 181 and 182.

In this case, since the area F1 is substantially greater than the area F2, the differential force is sufficient to displace the pistons 179 and 178 to the left from the positions shown in FIG. 8. This displacement continues to restore the normal starting position of the beam 139 until the abutment formed by shoulder 180 is engaged, the pressure then blocking the beam 139 in this normal starting position.

In the first embodiment of FIGS. 1 and 2 in a similar way as in the second embodiment of FIGS. 3 to 8, electrical container contacts 133 and 134 are mounted on the bottom support lateral surface 129 and an electrical contact 132 is mounted in the approximate center of the curved-in region 131 of the bottom support 130. Likewise the electrical container contacts 135 are provided in the center of the gripping plates 125.

These container contacts 135 are so constructed, that with simultaneous operation of each electrical container contact 135 and at least one of the contacts 132, 133 and 134 a ready signal is given to the loading apparatus operator or to the truck driver operating the extendable member 103, in order to indicate that the container 100 to be emptied is ready to be lifted and the extendable member 103 now can be operated in the particular emptying process for a particular container 100.

Alternatively additional electronic switching circuits can be provided in this case, so that simultaneous operation of the three named electrical container contacts can set in motion automatic operation of the lifting and dumping operations of the extendable member 103 and other parts of the loading apparatus.

Many modifications of the described embodiments are possible and take a variety of forms. So it is not absolutely required, that the component part limiting the pickup frame member 119 in its skewed or slanted position acts on the protruding member 18 mounted on the pickup frame member 119 alone or directly on the container-gripping member 124 and/or the bottom support 130.

As FIG. 2 shows, in these embodiments container electrical contacts 132, 133, 134 on the bottom support 130 and the container electrical contact 135 on the gripping plate 125 or a plurality of gripping plates 125 can be provided. These contacts can function thereby in the same way as in the second specific embodiment shown in FIGS. 3 to 8.

Instead of the structure shown in the drawings, the pickup attachment 115 can also occur in other structural forms, which fit the container to be emptied. Likewise also instead of the structure for the pickup support 116 given in the specific embodiments, other structural forms for the pickup support 116 fitting the container to be emptied can also be provided.

Figure 10:
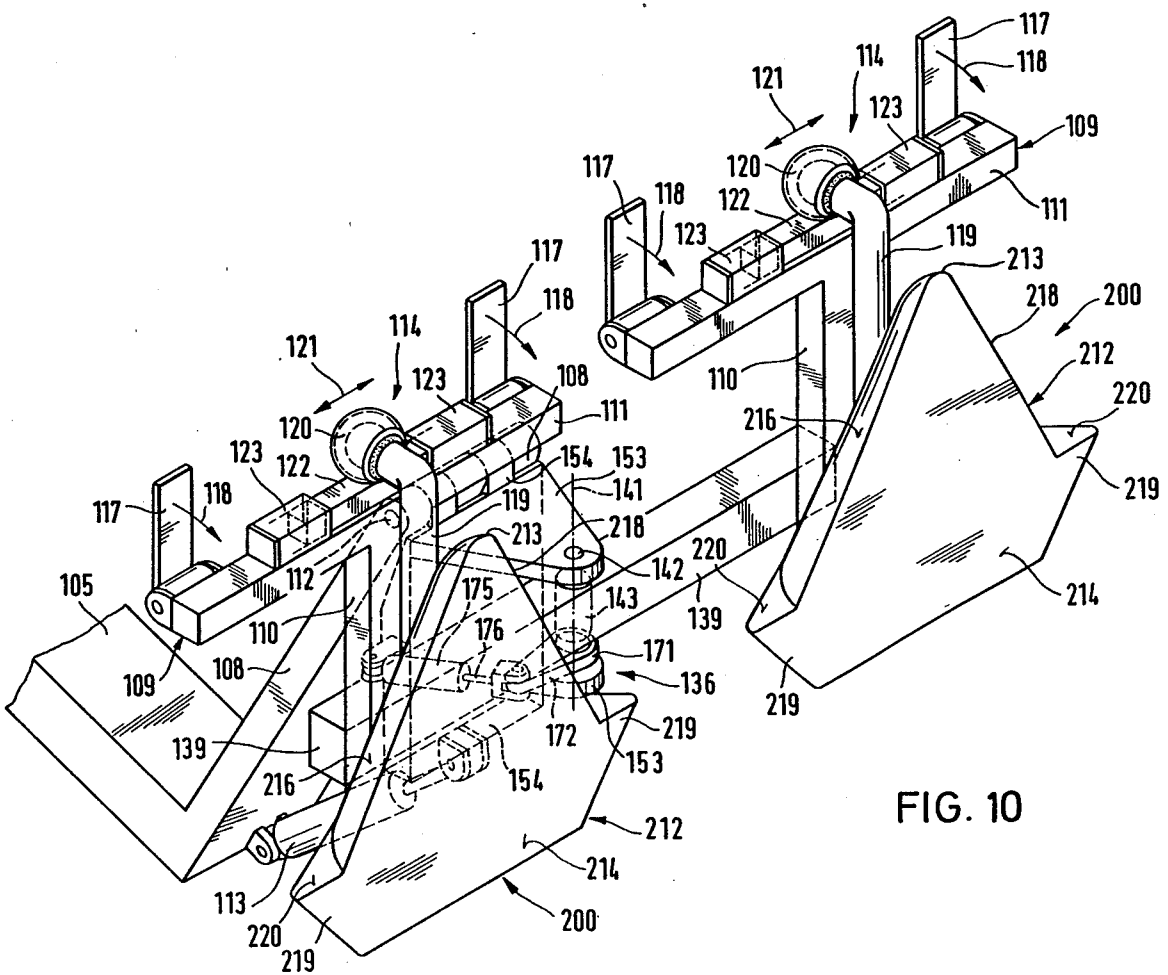
FIG. 10 is a perspective view illustrating how a pair of transport units not shown in FIG. 9 are joined with a common beam.
Figure 11:
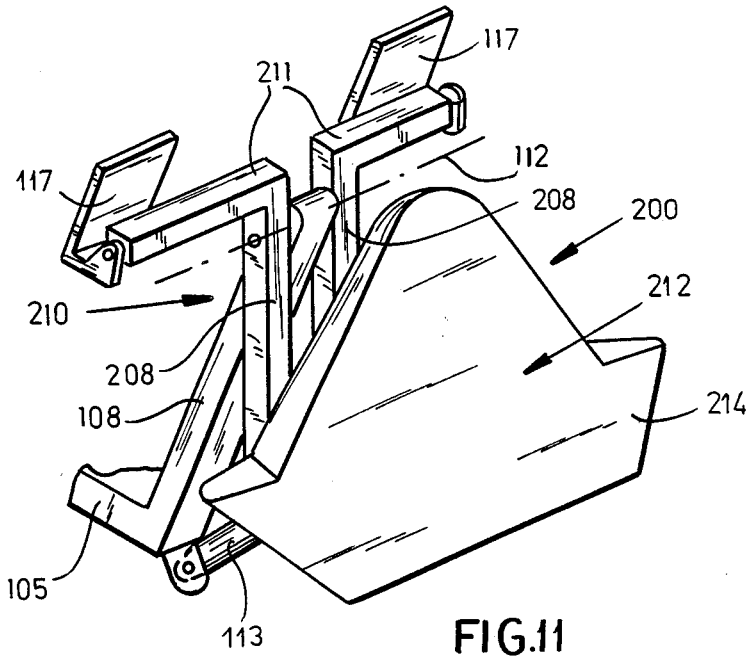
FIG. 11 is a perspective view of still another transport unit utilizing the principle of a triangular plate engageable in a pocket of a container.
Figure 12:
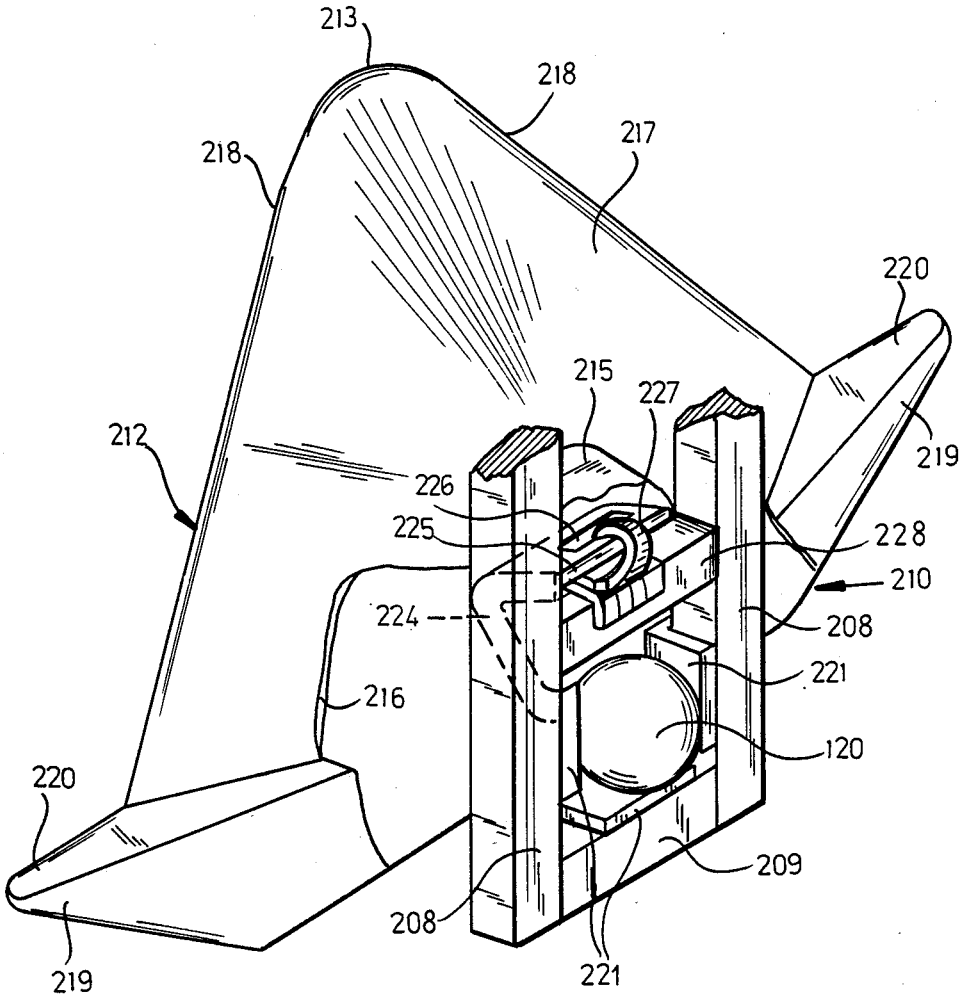
FIG. 12 is a fragmentary perspective view showing the opposite side of the structure shown in FIG. 11.

In the embodiment of FIGS. 9–14 the gripping units 100 each comprise a gripping support plate 212 as can especially be seen clearly from FIG. 12 but which are also provided in the remainder of FIGS. 9–14. The gripping and support plates 212 are substantially triangular with upwardly directed rounded apexes 213.

In the embodiments of FIGS. 9–14, the plates 212 are hollow and have a substantially planar bracing wall 214 turned toward the container to be lifted, a rear wall 215 turned away from the container and a peripheral wall 216 connecting the bracing wall 214 and the rear wall 215 along the upper edges and closing the hollow plate 212. The wall 216 may also be referred to here as a gripping wall and is formed along its outer sides with convexly bulged gripping surfaces 217 which form an acute angle at a gripping edge 218 with the planar surface 214. On both sides of the plate 212, ear-like lateral support elements 219 are provided which have upwardly turned support surfaces 220 for the walls of a pocket formed on the container and into which the plate 212 can insert.

Figure 9:
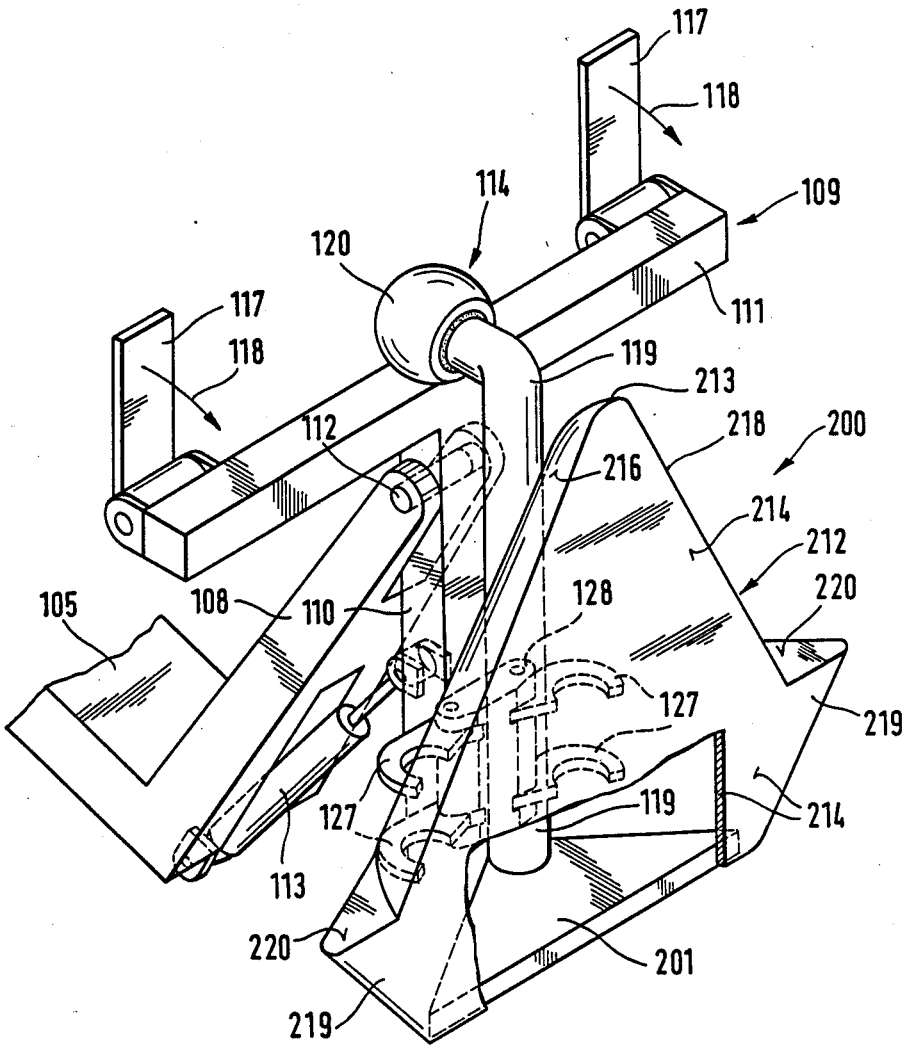
FIG. 9 is an illustration in a perspective view, partly broken away, of the gripper and bracing means forming a transport unit in accordance with another embodiment of the invention.

In the embodiment of FIGS. 9 and 10, each of the transport units 200 has its gripper plate 212 fixed to a bar-like support 119. As can be seen from FIG. 9, the bar-like support 119 at its lower end is fixedly connected with a triangular connecting plate 201.

This connecting plate 201 is fixed on the inner sides of the bracing wall 214, for example, by welding.

It its upper end, the bar-like support 119 is provided with a ball-shaped rubber-metal element 120 which can comprise an inner joint ball and an outer shell surrounding the ball and having a rubber layer vulcanized between the joint ball and shell. Each of the elements 120 can thus form a universal joint 114 of limited universal mobility when forces are applied thereto which overcome the restoring forces generated by the rubber element of the joint.

When no force is applied to the bar-shaped carrier 119, therefore, the rubber-metal element 120 forming the joint, holds the carrier 119 in its normal position.

The outer ball shall of the element 120 in the embodiment of FIG. 9 is directly fastened, e.g. by welding to the upper beam 111 of the tilting frame 110.

The joint 120 thus holds the respective gripper and carrier plate 212 with its bracing wall 214 in position until the wall engages the side of the container to be dumped and permits a self-adjustment of the plate against this wall to enable the plate to be engaged in the pocket.

As soon as the container is lifted, the element 120 automatically restores the plate into its normal position. In this normal position a locking device 127, 128 arrests the support 119 in essentially the same way as the arresting means 117 holds the gripper and bracing unit described in connection with FIG. 2.

In the embodiment of FIG. 10, a pair of such gripping and transport units 200 has respective tilting frames 110 (shown in broken line) to a common transverse beam 139 which forms a double-arm lever, fulcrummed at its midpoint between support lugs 153 on a support plate 154 via a rotary element 136 as has been described in connection with FIGS. 3–8.

In the embodiment of FIG. 10, each gripper and support unit 200 also has a joint 122, 123 permitting longitudinal movement (arrow 121) analogous to the longitudinal movement permitted by the gripper unit in FIG. 2, along the upper transverse arm 111.

This permits the two gripper units 200 to be shifted relative to one another in the direction of the double-headed arrow 121 at least limitedly.

Figure 13:
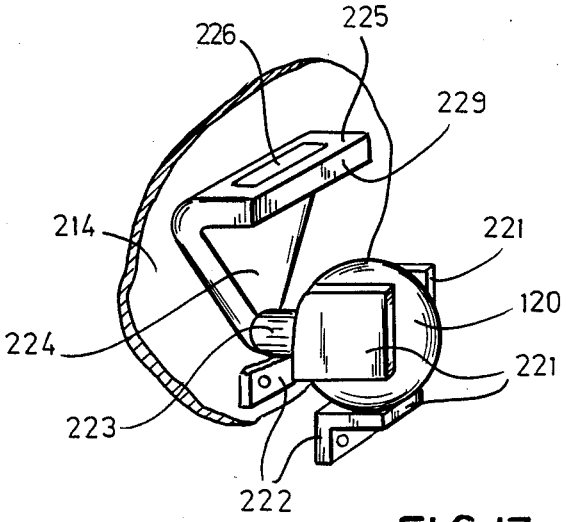
FIG. 13 is a fragmentary perspective view illustrating a detail of FIG. 12.

In the embodiments of FIGS. 11–13, the tilting support 210 has a pair of parallel vertical posts 208, each of which has a transverse bar 211 at its upper end. At their lower ends, the posts 208 are connected by a transverse bar 209.

Thus the upper transverse arm of the tilting frame 210 is formed by the two partial arms 211, each of which is formed on one of the posts 208 and carries a respective locking element 117 for the container to be engaged.

In this embodiment the end piece 108 of the lifting arm 105 engages between the two posts 208 and a pivotal connection about an axis 112 is formed between the end piece 108 and the posts 208.

Between the end piece 108 and the tilting frame 210, a piston-and-cylinder arrangement 113 is formed by analogy with the system of FIG. 2 which permits the angular position between end piece 108 and the posts 208 of the frame 2!0 to be established about the axis 112.

The connection between the tilting frame 210 and the gripping and transport plate 212 in the embodiment of FIGS. 11–14 is so effected that at the lower part of the tilting frame 210 a universal joint 114 utilizing a ball-shaped rubber-metal element 120, as previously described, is provided.

As FIGS. 12 and 13 show, the ball-shaped rubber-metal element 120 has a preferably steel shell provided with three angular retaining elements 221 with which the element 120 is held between the two posts 208 upon the lower transverse bar 209.

On the projecting flanged parts 222, the fastening elements 221 are fixed to the posts 208 and the transverse bar 209, for example, by bolting.

The ball-shaped element 120 has a shaft 223 of its inner joint ball fixed to a triangular connecting plate 224. This connecting plate 224 is, in turn, fastened on the inner side of the bracing wall 214 of the gripper plate 212, e.g. by welding.

At its upper portion, the connecting plate 224 is provided with a substantially right-angle bend to provide a locking plate 225.

In this locking plate, a locking slot 226 is formed parallel to the bracing wall 214. The locking plate 225 and the locking slot 226 cooperate with a locking hook 227 which is pivotally mounted in a transverse member 228 between the two posts 208 of the tilting frame 210 and which can be swung into engagement with or out of engagement from the slot 226. The transverse member 228 is provided at a sufficient distance above the lower transverse bar 209 to accommodate the ball-shaped rubber-metal element 120 between the lower transverse bar 209 and member 228.

When the locking hook 227 is brought into engagement with the locking slot 226, the locking plate 225 is held on the transverse member 228 preferably with contact of its face 229 with the transverse member 228.

In this manner a rigid arresting of the gripper and support plate 212 is effected on its tilting frame 210.

When the locking hook 227 is released from engagement with the slot 226, the plate 212 can move limitedly with the degrees of movement permitted by element 120 relative to its tilting frame to compensate for the position of the container to be lifted.

When the container is then lifted from the ground, element 120 restores the normal position of plate 212 with respect to its frame 210 in the manner described and in this normal position, the locking hook 227 can engage the slot 226 to fix the plate 212 in its normal position.

The controlled movement of the locking hook between it engaged and its released position can be effected by any desired means, for example, by a piston-and-cylinder arrangement built into the cross member 228.

Figure 14:
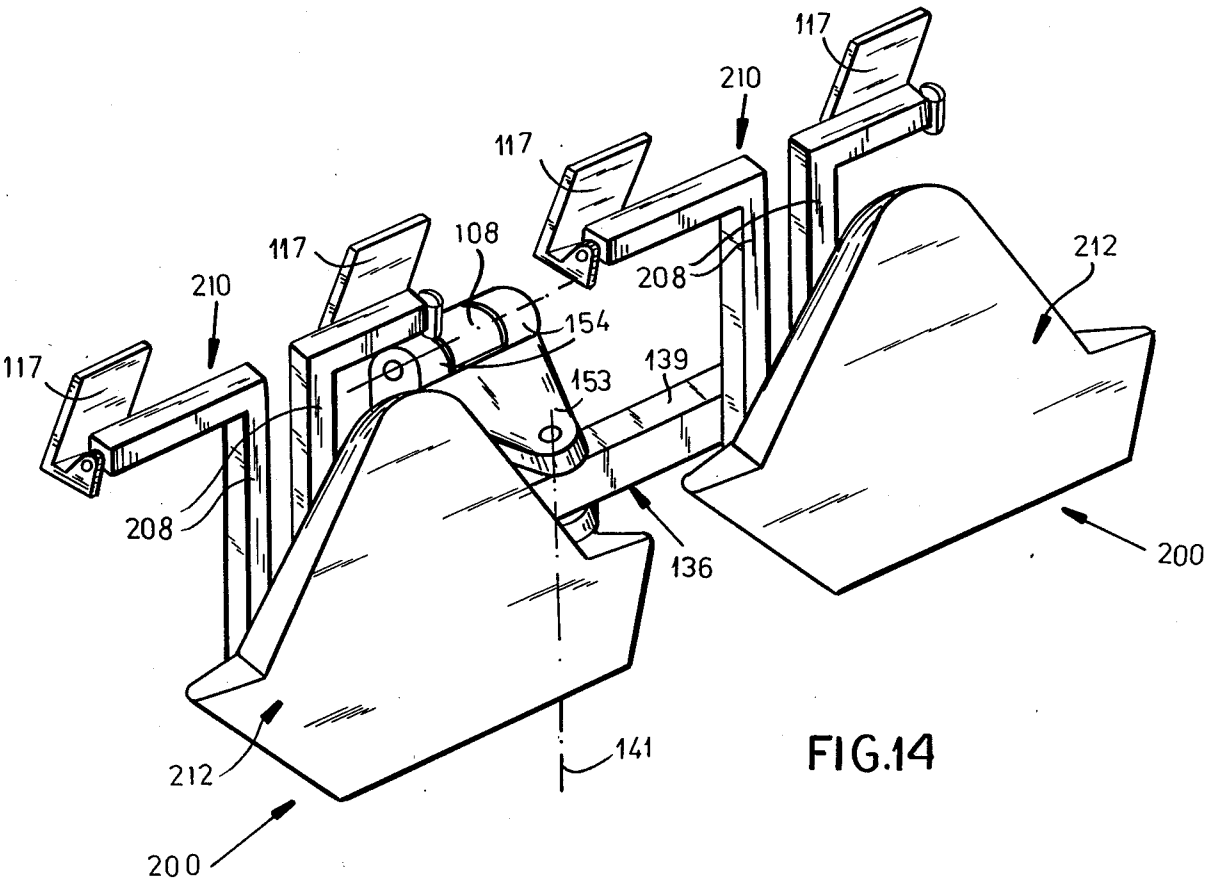
FIG. 14 is a perspective view of a dumping apparatus provided with two transport devices of the type shown in FIGS. 11–13.

In the embodiment of FIG. 14, a pair of the gripper and carrier units 200 as described in connection with FIGS. 11–13 are shown on a common transverse beam 139 as has been described in connection with FIGS. 3–10. The beam 139 is here also formed on its midpoint with a rotator element 136 with which it can pivot about an axis 161.

Figure 6:
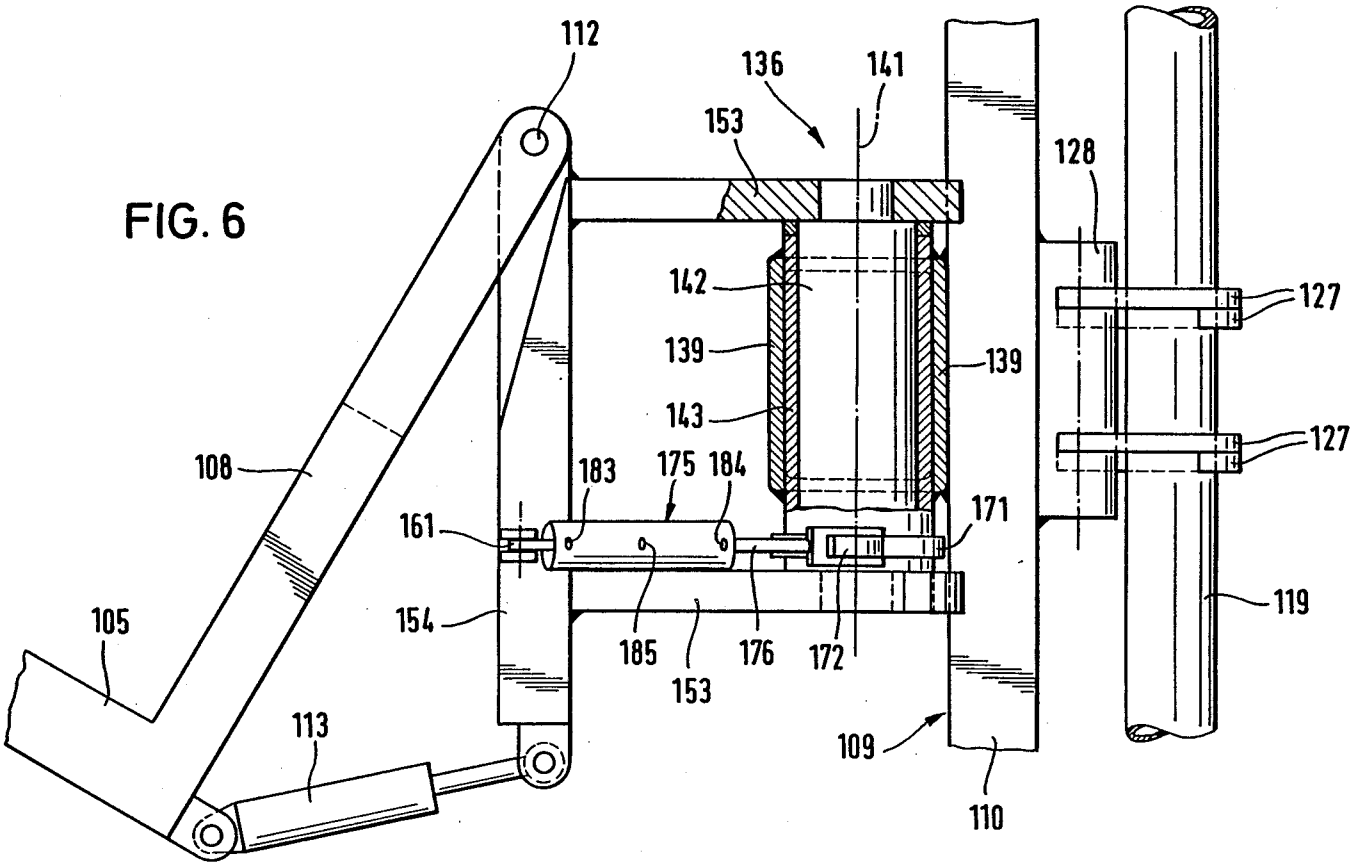
FIG. 6 is a detail view of a portion of FIG. 4 generally taken along the line VI—VI thereof.

The rotator element 136 can have the same construction as that described in connection with FIG. 6 and can be received between two lugs 153 which, as has been illustrated in FIG. 10, are affixed to a carrier plate 154.

In that case, the end piece 108 of the extensible and liftable arm can be received between two upper eyes of the support plate 154 so that the end piece 108 is pivotally connected to these eyes of the support plate 154.

The posts 208 of the tilting frames 210 are, as has been indicated in FIG. 14, fixed to the transverse beam 139, for example, by a welding or bolting. In all remaining aspects, the construction of the transport units 200 can be the same as that described for the transport unit of FIGS. 11–13.

We claim:

1. A container-dumping apparatus for the emptying of a container into a collecting receptacle, especially for the dumping of refuse bins into a refuse-collecting truck, said apparatus comprising:

a container tilting frame adapted to be approached to a container to be dumped and having a tilting axis about which said frame can be tilted;

gripper means on said frame engageable with said container for enabling entrainment of the container with the frame;

bracing means on said frame adapted to bear against said container when said container is engaged by said gripper means to take up at least part of the weight of said container;

connecting means on said frame joining said gripper means and said bracing means into a transport unit adapted to retain and support said container;

an entraining device for coupling said transport unit with said tilting frame while permitting limited mobility of said transport unit relative to said tilting frame;

position-restoring and alignment means between said unit and said tilting frame and effective upon lifting of said tilting frame, said unit and the container carried thereby for shifting said unit into a predetermined normal starting position relative to said frame for dumping of said container upon a displacement of said unit from said predetermined normal starting position into an off-normal position as permitted by said entraining device upon engagement of said gripper means with said container; and arresting means on said frame actuatable for locking said unit in said normal position upon displacement of said unit into said normal position by said position-restoring and alignment means as said tilting frame is lifted for dumping of said container and for releasing said unit upon lowering of said tilting frame for the limited mobility of said unit relative to the frame permitted by said entraining device.

2. The container-dumping apparatus defined in claim 1 wherein said entraining device is constructed and arranged to permit limited displacement of said unit in a lateral direction parallel to said tilting axis of said frame to opposite sides of said normal position.

3. The container-dumping apparatus defined in claim 1 wherein said entraining device is constructed and arranged to permit limited pivotal displacement of said unit about a substantially vertical axis to opposite sides of said normal position.

4. The container-dumping apparatus defined in claim 1 wherein said entraining device is constructed and arranged to permit limited swinging pendulous displacement substantially in a vertical plane parallel to said tilting axis of said frame to opposite sides of said normal position.

5. The container-dumping apparatus defined in claim 1 wherein said entraining device is constructed and arranged to permit limited inclination in said plane which is normal to a tilting axis of said frame.

6. The container-dumping apparatus defined in claim 1 wherein said connecting means includes a support which is substantially vertical in a container-pickup position of said frame and said unit and connected said gripper means and said bracing means to said tilting frame.

7. A container-dumping apparatus for the emptying of a container into a collecting receptacle, especially for the dumping of refuse bins into a refuse-collecting truck, said apparatus comprising:

a container tilting frame adapted to be approached to a container to be dumped and having a tilting axis about which said frame can be tilted;

gripper means on said frame engageable with said container for enabling entrainment of the container with the frame;

bracing means on said frame adapted to bear against said container when said container is engaged by said gripper means to take up at least part of the weight of said container;

connecting means on said frame joining said gripper means and said bracing means into a transport unit adapted to retain and support said container;

an entraining device for coupling said transport unit with said tilting frame while permitting limited mobility of said transport unit relative to said tilting frame;

position-restoring and alignment means between said unit and said tilting frame and effective upon lifting of said tilting frame, said unit and the container carried thereby for shifting said unit into a predetermined normal starting position relative to said frame for dumping of said container upon a displacement of said unit from said predetermined normal starting position into an off-normal position as permitted by said entraining device upon engagement of said gripper means with said container; and arresting means on said frame actuatable for locking said unit in said normal position upon displacement of said unit into said normal position by said position-restoring and alignment means as said tilting frame is lifted for dumping of said container and for releasing said unit upon lowering of said tilting frame for the limited mobility of said unit relative to the frame permitted by said entraining device, said connecting means including a support which is substantially vertical in a container-pickup position of said frame and said unit and connected said gripper means and said bracing means to said tilting frame, said entraining device including means forming a universal-type of swivel joint connecting said support to said tilting frame, and a rubber-metal mobility-limiting element.

8. A container-dumping apparatus for the emptying of a container into a collecting receptacle, especially for the dumping of refuse bins into a refuse-collecting truck, said apparatus comprising:

a container tilting frame adapted to be approached to a container to be dumped and having a tilting axis about which said frame can be tilted;

gripper means on said frame engageable with said container for enabling entrainment of the container with the frame;

bracing means on said frame adapted to bear against said container when said container is engaged by said gripper means to take up at least part of the weight of said container;

connecting means on said frame joining said gripper means and said bracing means into a transport unit adapted to retain and support said container;

an entraining device for coupling said transport unit with said tilting frame while permitting limited mobility of said transport unit relative to said tilting frame;

position-restoring and alignment means between said unit and said tilting frame and effective upon lifting of said tilting frame, said unit and the container carried thereby for shifting said unit into a predetermined normal starting position relative to said frame for dumping of said container upon a displacement of said unit from said predetermined normal starting position into an off-normal position as permitted by said entraining device upon engagement of said gripper means with said container; and arresting means on said frame actuatable for locking said unit in said normal position upon displacement of said unit into said normal position by said position-restoring and alignment means as said tilting frame is lifted for dumping of said container and for releasing said unit upon lowering of said tilting frame for the limited mobility of said unit relative to the frame permitted by said entraining device, said connecting means including a support which is substantially vertical in a container-pickup position of said frame and said unit and connected said gripper means and said bracing means to said tilting frame, said entraining device and said position-restoring and alignment means being formed by a coupling between said unit and said frame which automatically generates a reporting force upon displacement of said unit into said off-normal position counteracting the latter displacement, said coupling including a rubber-metal device in the form of a universal joint.

9. The container-dumping apparatus defined in claim 8 wherein said arresting means includes claw members pivotally mounted on said frame and engageable around said support to seize said support in tongs formed by said members.

10. A container-dumping apparatus for the emptying of a container into a collecting receptacle, especially for the dumping of refuse bins into a refuse-collecting truck, said apparatus comprising:

a container tilting frame adapted to be approached to a container to be dumped and having a tilting axis about which said frame can be tilted;

gripper means on said frame engageable with said container for enabling entrainment of the container with the frame;

bracing means on said frame adapted to bear against said container when said container is engaged by said gripper means to take up at least part of the weight of said container;

connecting means on said frame joining said gripper means and said bracing means into a transport unit adapted to retain and support said container;

an entraining device for coupling said transport unit with said tilting frame while permitting limited mobility of said transport unit relative to said tilting frame;

position-restoring and alignment means between said unit and said tilting frame and effective upon lifting of said tilting frame, said unit and the container carried thereby for shifting said unit into a predetermined normal starting position relative to said frame for dumping of said container upon a displacement of said unit from said predetermined normal starting position into an off-normal position as permitted by said entraining device upon engagement of said gripper means with said container; and arresting means on said frame actuatable for locking said unit in said normal position upon displacement of said unit into said normal position by said position-restoring and alignment means as said tilting frame is lifted for dumping of said container and for releasing said unit upon lowering of said tilting frame for the limited mobility of said unit relative to the frame permitted by said entraining device, said connecting means including a support which is substantially vertical in a container-pickup position of said frame and said unit and connected said gripper means and said bracing means to said tilting frame, said entraining means forming a joint between said support and said frame and said position-restoring and alignment means are formed by a spring-biased centering device on said frame connected to said unit away from said joint.

11. A container-dumping apparatus for the emptying of a container into a collecting receptacle, especially for the dumping of refuse bins into a refuse-collecting truck, said apparatus comprising:

a container tilting frame adapted to be approached to a container to be dumped and having a tilting axis about which said frame can be tilted;

gripper means on said frame engageable with said container for enabling entrainment of the container with the frame;

bracing means on said frame adapted to bear against said container when said container is engaged by said gripper means to take up at least part of the weight of said container;

connecting means on said frame joining said gripper means and said bracing means into a transport unit adapted to retain and support said container;

an entraining device for coupling said transport unit with said tilting frame while permitting limited mobility of said transport unit relative to said tilting frame;

position-restoring and alignment means between said unit and said tilting frame and effective upon lifting of said tilting frame, said unit and the container carried thereby for shifting said unit into a predetermined normal starting position relative to said frame for of said container upon a displacement of said unit from said predetermined normal starting position into an off-normal position as permitted by said entraining device upon engagement of said gripper means with said container; and arresting means on said frame actuatable for locking said unit in said normal position upon displacement of said unit into said normal position by said position-restoring and alignment means as said tilting frame is lifted for dumping of said container and for releasing said unit upon lowering of said tilting frame for the limited mobility of said unit relative to the frame permitted by said entraining device, said connecting means including a support which is substantially vertical in a container-pickup position of said frame and said unit and connected said gripper means and said bracing means to said tilting frame, said gripper means including a receiving bar extending generally parallel to a tilting axis of said frame and adapted to at least partly receive said container, said bracing means includes a bracing bar substantially parallel to said receiving bar, and said apparatus includes a plurality of electrical contacts spaced apart on said bars for issuing a signal automatically causing the lifting and dumping of the container upon detection of the engagement of said container by said unit as signalled by at least three of said contacts.

12. The container-dumping apparatus defined in claim 11 wherein two of said contacts are provided in longitudinally spaced relationship along said bar parallel to said axis and said signal is issued only upon actuation of both of said two contacts.

13. A container-dumping apparatus for the emptying of a container into a collecting receptacle, especially for the dumping of refuse bins into a refuse-collecting truck, said apparatus comprising:

a container tilting frame adapted to be approached to a container to be dumped and having a tilting axis about which said frame can be tilted;

gripper means on said frame engageable with said container for enabling entrainment of the container with the frame;

bracing means on said frame adapted to bear against said container when said container is engaged by said gripper means to take up at least part of the weight of the container;

connecting means on said frame joining said gripper means and said bracing means into a transport unit adapted to retain and support said container;

an entraining device for coupling said transport unit with said tilting frame while permitting limited mobility of said transport unit relative to said tilting frame;

position-restoring and alignment means between said unit and said tilting frame and effective upon lifting of said tilting frame, said unit and the container carried thereby for shifting said unit into a predetermined normal starting position relative to said frame for dumping of said container upon a displacement of said unit from said predetermined normal starting position into an off-normal position as permitted by said entraining device upon engagement of said gripper means with said container; and arresting means on said frame actuatable for locking said unit in said normal position upon displacement of said unit into said normal position by said position-restoring and alignment means as said tilting frame is lifted for dumping of said container and for releasing said unit upon lowering of said tilting frame for the limited mobility of said unit relative to the frame permitted by said entraining device, said connecting means including a support which is substantially vertical in a container-pickup position of said frame and said unit and connected said gripper means and said bracing means to said tilting frame, said apparatus having an outrigger arm extending from a rubbish-collecting vehicle and carrying said tilting frame for tilting thereof about a tilting axis, and means for raising and lowering said outrigger arm.

14. The container-dumping apparatus defined in claim 13 wherein said outrigger arm has an endpiece and said frame is swingable about a horizontal axis on said endpiece, said horizontal axis being said tilting axis, said apparatus further comprising a piston-and-cylinder arrangement operatively connecting said endpiece to said frame for tilting said frame relative to said endpiece about said horizontal axis.

15. The container-dumping apparatus defined in claim 13, further comprising means enabling rotation of said tilting frame relative to said endpiece about a substantially vertical axis, and a positioning-and-blocking cylinder between said endpiece and said frame for swinging said frame about said substantially vertical axis into said normal position and then blocking said frame in said normal position.

16. A container-dumping apparatus for the emptying of at least one container into a collecting receptacle, especially for the dumping of refuse bins into a refuse-collecting truck, said apparatus comprising:

a common carrier provided with means for lifting same for container dumping and with a bracket adapted to be approached to a single large container or a plurality of small containers in side by side relationship to be dumped;

a transverse support beam pivotally mounted on by a rotator element on said bracket for swinging movement about at least a substantially vertical axis; and a plurality of container-engaging mechanisms spaced apart along said support beam, each of said container-engaging mechanisms comprising:

a container tilting frame adapted to be approached to a container to be dumped, gripper means on said frame engageable with a container juxtaposed with said tilting frame for enabling entrainment by the frame of the container juxtaposed with the frame, bracing means on said frame adapted to bear against the container juxtaposed with the frame when said container juxtaposed with the frame is engaged by said gripper means to take up at least part of the weight of the container juxtaposed with the frame, respective connecting means on said frame joining said gripper means and said bracing means into a respective transport unit, a respective entraining device for coupling each of said transport units with a respective one of said tilting frames while permitting limited mobility of each said transport unit relative to the respective said tilting frame, position-restoring and alignment means between each said unit and the respective said tilting frame and effective upon lifting of said tilting frame, said unit and the container carried thereby for shifting each said unit into a predetermined normal starting position relative to the respective said frame for dumping of said container upon a displacement of each unit from said predetermined normal starting position into an off-normal position as permitted by said entraining device upon engagement of said gripper means with the container juxtaposed with the respective frame, and arresting means on each frame actuatable for locking the respective said unit in its said normal position upon displacement of each unit into its normal position by said position-restoring and alignment means as each tilting frame is lifted for dumping of said container and for releasing each unit upon lowering of said tilting frames for the limited mobility of each unit relative to the respective frame permitted by the respective entraining device;

restoring means between said beam and said carrier for returning said beam to a normal starting orientation upon lifting of said beam about said substantially vertical axis; and blocking means acting upon said beam for fixing same in said normal starting orientation and releasable to permit swinging movement of said beam about said substantially vertical axis.

17. The container-dumping apparatus defined in claim 16 wherein a pair of said frames each with a respective said transport unit are mounted on said beam on opposite sides of said substantially vertical axis, said beam forming a two-arm lever fulcrummed on said bracket.

18. The container-dumping apparatus defined in claim 17 wherein said rotator element is provided with said restoring means.

19. The container-dumping apparatus defined in claim 16 wherein said restoring means includes a hydraulic setting and blocking device connected to a hydraulic operating and control system for lifting the carrier and connected between said rotator element and said bracket.

20. The container-dumping apparatus defined in claim 19 wherein said hydraulic setting and blocking device is continuously supplied on opposite sides by said system with hydraulic medium and has a differential piston with a larger effective surface area biasing said piston in a direction tending to return said beam to said normal starting orientation.

21. A container-dumping apparatus for the emptying of a container into a collecting receptacle, especially for the dumping of refuse bins into a refuse-collecting truck, said apparatus comprising:

a container tilting frame adapted to be approached to a container to be dumped;

a gripping and support plate on said frame engageable in a pocket formed on said container to enable lifting and tilting thereof, said gripping and support plate forming a transport unit for said container;

an entraining device for coupling said transport unit with said tilting frame while permitting limited mobility of said transport unit relative to said tilting frame;

position-restoring and alignment means between said unit and said tilting frame and effective upon lifting of said tilting frame, said unit and the container carried thereby for shifting said unit into a predetermined normal starting position relative to said frame for dumping of said container upon a displacement of said unit from said predetermined normal starting position into an off-normal position as permitted by said entraining device upon engagement of said plate with said container; and arresting means on said frame actuatable for locking said unit in said normal position upon displacement of said unit into said normal position by said position-restoring and alignment means as said tilting frame is lifted for dumping of said container and for releasing said unit upon lowering of said tilting frame for the limited mobility of said unit relative to the frame permitted by said entraining device.

22. A container-dumping apparatus for the emptying of at least one container into a collecting receptacle, especially for the dumping of refuse bins into a refuse-collecting truck, said apparatus comprising:

a common carrier provided with means for lifting same for container dumping and with a bracket adapted to be approached to a single large container or a plurality of small containers in side by side relationship to be dumped;

a transverse support beam pivotally mounted on by a rotator element on said bracket for swinging movement about at least a substantially vertical axis; and a pair of container-engaging mechanisms mounted on said support beam on opposite sides of said substantially vertical axis, each of said container-engaging mechanisms comprising:

container tilting frame adapted to be approached to a container to be dumped;

a respective gripping and support plate on said frame engageable in a pocket formed on a said container juxtaposed with the respective frame to enable lifting and tilting thereof, said gripping and support plate forming a transport unit for said container juxtaposed with the respective frame, a respective entraining device for coupling each said transport unit with the respective said tilting frame while permitting limited mobility of the respective said transport unit relative to the respective tilting frame, and a respective position-restoring and alignment means between each said unit and the respective tilting frame and effective upon lifting of said respective tilting frame, each said unit and the container carried thereby for shifting each unit into a predetermined normal starting position relative to said frame for dumping of said container upon a displacement of said unit from said predetermined normal starting position into an off-normal position as permitted by the respective said entraining device upon engagement of said plate with said container; restoring means between said beam and said carrier for returning said beam to a normal starting orientation upon lifting of said beam about said substantially vertical axis; and blocking means acting upon said beam for fixing same in said normal starting orientation and releasable to permit swinging movement of said beam about said substantially vertical axis.

23. A container-dumping apparatus for the emptying of at least one container into a collecting receptacle, especially for the dumping of refuse bins into a refuse-collecting truck, said apparatus comprising:

a common carrier provided with means for lifting same for container dumping and adapted to be approached to a single large container or a plurality of small containers in side by side relationship to be dumped; and a pair of container-engaging mechanism mounted on said support beam on opposite sides of said substantially vertical axis, each of said container-engaging mechanism comprising:

container tilting frame adapted to be approached to a container to be dumped;

a respective gripping and support plate on said frame engageable in a pocket formed on a said container juxtaposed with the respective frame to enable lifting and tilting thereof, said gripping and support plate forming a transport unit for said container juxtaposed with the respective frame, a respective entraining device for coupling each said transport unit with the respective said tilting frame while permitting limited mobility of the respective said transport unit relative to the respective tilting frame, a respective position-restoring and alignment means between each said unit and the respective tilting frame and effective upon lifting of said respective tilting frame, each said unit and the container carried thereby for shifting each unit into a predetermined normal starting position relative to said frame for dumping of said container upon a displacement of said unit from said predetermined normal starting position into an off-normal position as permitted by the respective said entraining device upon engagement of said plate with said container, and respective arresting means on each said frame actuatable for locking the respective said unit in the respective said normal position upon displacement of the respective said unit into its said normal position by the respective said position-restoring and alignment means as said tilting frames are lifted for dumping of said container and for releasing said units upon lowering of said tilting frames for the limiting mobility of said units relative to the frames permitted by said entraining devices, said carrier being provided with a transverse beam limitedly swingable by a rotator element about a substantially vertical axis and forming a two-arm lever, each of said plates being mounted on a respective arm of said lever.

24. The container-dumping apparatus defined in claim 23 wherein said rotator element is provided with restoring means for urging said beam into a normal starting position about said substantially vertical axis upon limited displacement of said beam out of said normal starting position.

25. The container-dumping apparatus defined in claim 23 wherein said plates have gripping surfaces with a convex bulge inclined downwardly away from a juxtaposed container.

26. The container-dumping apparatus defined in claim 23 wherein said gripping surfaces are also convexly curved along their dip lines of steepest gradient.

27. The container-dumping apparatus defined in claim 24 wherein said plates are each formed with a pair of oppositely extending lateral ear-like projections having upper surfaces adapted to brace against a wall of said container which is formed with pockets for receiving said plate.

* * * * *